US010655625B2

(12) United States Patent
Yamada et al.

(10) Patent No.: US 10,655,625 B2
(45) Date of Patent: May 19, 2020

(54) SCROLL COMPRESSOR

(71) Applicant: Panasonic Intellectual Property Management Co., Ltd., Osaka-shi, Osaka (JP)

(72) Inventors: Sadayuki Yamada, Gunma (JP); Takeshi Ogata, Osaka (JP); Yusuke Imai, Shiga (JP); Atsushi Sakuda, Shiga (JP); Takashi Morimoto, Kyoto (JP); Akihiro Hayashi, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 92 days.

(21) Appl. No.: 15/120,871

(22) PCT Filed: Jun. 8, 2015

(86) PCT No.: PCT/JP2015/002856

§ 371 (c)(1),
(2) Date: Aug. 23, 2016

(87) PCT Pub. No.: WO2015/194119

PCT Pub. Date: Dec. 23, 2015

(65) Prior Publication Data

US 2016/0363121 A1 Dec. 15, 2016

(30) Foreign Application Priority Data

Jun. 20, 2014 (JP) ..... 2014-126892
Jul. 3, 2014 (JP) ..... 2014-137824

(51) Int. Cl.
*F04C 18/02* (2006.01)
*F04C 29/12* (2006.01)
(Continued)

(52) U.S. Cl.
CPC ..... *F04C 18/0215* (2013.01); *F04C 18/0261* (2013.01); *F04C 18/0292* (2013.01);
(Continued)

(58) Field of Classification Search
CPC .. F04C 18/0215; F04C 29/128; F04C 29/126; F04C 28/26
(Continued)

(56) References Cited

U.S. PATENT DOCUMENTS 5,102,316 A 4/1992 Caillat et al.
6,056,523 A * 5/2000 Won ..... F04C 23/008 418/15
(Continued)

FOREIGN PATENT DOCUMENTS

EP 0 479 421 A1 4/1992
JP 63235681 A * 9/1988 ..... F04C 18/0215
(Continued)

OTHER PUBLICATIONS

English translatio of JP63235681 by Espacenet, Apr. 5, 2019.*
(Continued)

*Primary Examiner* — Deming Wan
(74) *Attorney, Agent, or Firm* — Hamre, Schumann, Mueller & Larson, P.C.

(57) ABSTRACT

A scroll compressor includes a pillar-shaped member that is inserted into a scroll-side engagement section formed on a stationary scroll. A lower end-face of an engagement section between the pillar-shaped member and the scroll-side engagement section is located above a lap end-face of a stationary spiral lap.

5 Claims, 12 Drawing Sheets

(51) Int. Cl.

| | |
|---|---|
| ***F04C 28/26*** | (2006.01) |
| ***F04C 2/10*** | (2006.01) |
| ***F04C 2/107*** | (2006.01) |
| ***F04C 2/02*** | (2006.01) |
| ***F01C 1/02*** | (2006.01) |
| ***F04C 27/00*** | (2006.01) |
| ***F04C 28/16*** | (2006.01) |
| ***F04C 23/00*** | (2006.01) |
| *F04C 29/02* | (2006.01) |

(52) U.S. Cl.
CPC ..... *F04C 23/008* (2013.01); *F04C 27/005* (2013.01); *F04C 28/16* (2013.01); *F04C 28/26* (2013.01); *F04C 29/023* (2013.01); *F04C 2210/22* (2013.01); *F04C 2240/10* (2013.01); *F04C 2240/20* (2013.01); *F04C 2240/40* (2013.01); *F04C 2240/50* (2013.01); *F04C 2240/60* (2013.01); *F04C 2240/805* (2013.01)

(58) Field of Classification Search
USPC ..... 418/55.1–55.5
See application file for complete search history.

(56) References Cited

U.S. PATENT DOCUMENTS

| | | | | |
|---|---|---|---|---|
| 2006/0233655 | A1* | 10/2006 | Clendenin | F01C 1/0215 418/55.1 |
| 2010/0303659 | A1* | 12/2010 | Stover | F04C 18/0215 418/24 |
| 2013/0078128 | A1 | 3/2013 | Akei | |
| 2016/0377081 | A1* | 12/2016 | Cho | F04C 29/02 418/55.1 |

FOREIGN PATENT DOCUMENTS

| | | |
|---|---|---|
| JP | 4-255586 | 9/1992 |
| JP | 9-177683 | 7/1997 |
| JP | 9-507548 | 7/1997 |
| JP | 11-022660 | 1/1999 |
| JP | 11-182463 | 7/1999 |
| JP | 2000-097171 | 4/2000 |
| WO | 2012/041259 A1 | 4/2012 |

OTHER PUBLICATIONS

Englished translation of Japanese Patent JP63235681 by Espacenet Apr. 5, 2019.*
The Extended European Search Report dated Aug. 11, 2017 for the related European Patent Application No. 15809073.8, 7 pages.

* cited by examiner

SCROLL COMPRESSOR

TECHNICAL FIELD

The present disclosure relates to a scroll compressor.

BACKGROUND ART

In recent years, the hermetic scroll compressor has been known which includes: a partition plate disposed inside a compressing container; a compressing element including a stationary scroll and an orbiting scroll, and disposed inside a low pressure chamber partitioned by the partition plate; and a motor for driving the orbiting scroll. The proposed hermetic scroll compressor of this type has a boss section of a stationary scroll fit into a retainer hole of the partition plate, and discharges a coolant compressed by the compressing element into a high pressure chamber partitioned by the partition plate via a discharge port of the stationary scroll (e.g. refer to patent literature 1).

In the scroll compressor typically disclosed in patent literature 1, the compressing element is amid a space of low pressure, thus the orbiting scroll and the stationary scroll receive the force that works for moving these two scrolls apart from each other.

A tip-seal is thus often used to strengthen the hermetic properties of the compressing chamber formed of the orbiting scroll and the stationary scroll.

Nevertheless, to drive the compressor more efficiently, a back pressure is preferably applied to the orbiting scroll or the stationary scroll. For instance, patent literature 2 discloses that a back pressure is applied to a stationary scroll for urging the stationary scroll against an orbiting scroll so that the tip seal can be eliminated, and yet, the hermetic properties can be improved.

The conventional scroll compressors, however, have been encountered with the following problems that cause a lower reliability: the stationary scroll is overturned by gas force within the compressing chamber, or the stationary scroll is rocked to degrade the performance of the compressor.

CITATION LIST

Patent Literature 1: Unexamined Japanese Patent Application No. H11-182463

Patent Literature 2: Unexamined Japanese Patent Application No. H04-255586

SUMMARY OF INVENTION

The present disclosure provides a reliable scroll compressor.

The scroll compressor of the present disclosure includes: a partition plate for partitioning a hermetic container into a high pressure space and a low pressure space; a stationary scroll abutting on the partition plate and including a stationary spiral lap; an orbiting spiral lap engaging with the stationary spiral lap of the stationary scroll; an orbiting scroll for forming a compressing chamber between these laps (i.e. stationary spiral lap and the orbiting spiral lap); a self-rotation preventing member for preventing the orbiting scroll from orbiting; and a main bearing for supporting the orbiting scroll. In this scroll compressor, the stationary scroll, the orbiting scroll, the self-rotation preventing member, and the main bearing are disposed in the low pressure space, and the stationary scroll is movable along an axial direction between the partition plate and the main bearing.

The scroll compressor further comprises the following structural elements: a bearing-side engagement section formed at the main bearing; a scroll-side engagement section formed at the stationary scroll; and a pillar-shaped member of which lower section is inserted into the bearing-side engagement section and of which upper section is inserted into the scroll-side engagement section. A lower end-face of an engaging section between the pillar-shaped member and the scroll-side engagement section is located above a lap end-face of the stationary spiral lap in the axial direction.

PREFERRED EMBODIMENTS OF THE DISCLOSURE

First Exemplary Embodiment

The first embodiment of the present disclosure is demonstrated hereinafter with reference to the accompanying drawings. The embodiments below will not limit the scope of the present disclosure.

Figure 1:
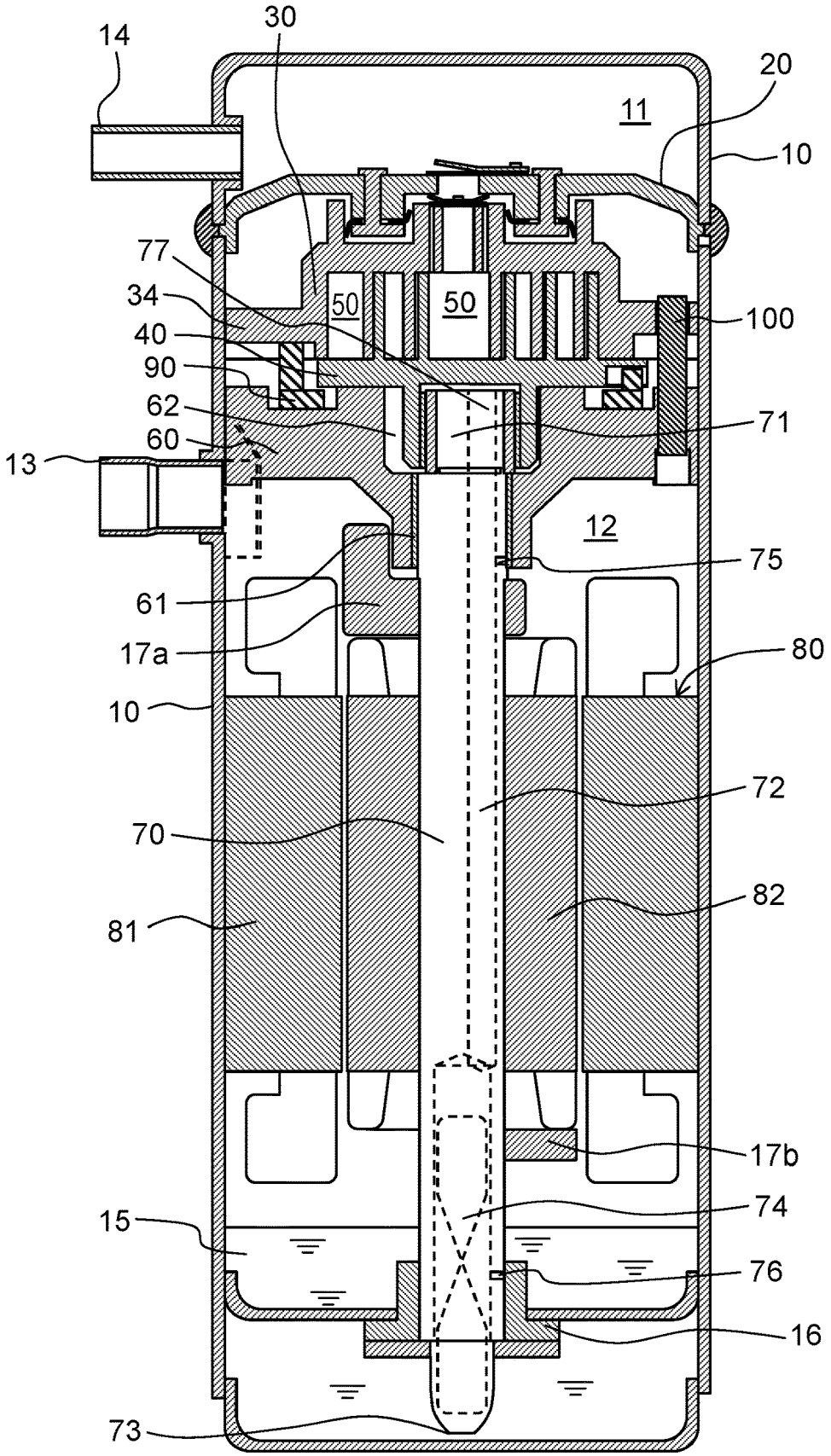
FIG. 1 is a longitudinal sectional view showing a structure of a hermetic scroll compressor in accordance with a first embodiment of the present disclosure.

FIG. 1 is a longitudinal sectional view showing a structure of the hermetic scroll compressor in accordance with the first embodiment. As FIG. 1 shows, this compressor includes cylindrically-shaped hermetic container 10 extending vertically.

Partition plate 20 is disposed in an upper section of container 10 for partitioning container 10 into high pressure space 11 and low pressure space 12.

Hermetic container 10 includes coolant suction pipe 13 for introducing a coolant into low pressure space 12, and coolant discharge pipe 14 for discharging the compressed coolant from high pressure space 11. At the bottom of low pressure space 12, oil pool 15 is formed for storing a lubricant.

Stationary scroll 30 and orbiting scroll 40 are disposed as a compressing mechanism in low pressure space 12. Stationary scroll 30 abuts on partition plate 20. Orbiting scroll 40 engages with stationary scroll 30 for forming compressing chamber 50.

Main bearing 60 is disposed below stationary scroll 30 and orbiting scroll 40 for supporting orbiting scroll 40. Bearing section 61 and boss receptor 62 are formed at approx. center of main bearing 60. Return pipe 63 is formed in main bearing 60 (refer to FIG. 6). A first end of return pipe 63 opens at boss receptor 62, and a second end thereof opens at an underside of main bearing 60. The first end of return pipe 63 can open at a top face of main bearing 60, and the second end can open at a lateral face of main bearing 60.

Bearing section 61 journals rotary shaft 70.

Rotary shaft 70 is supported by bearing section 61 and sub-bearing 16. At the upper end of rotary shaft 70, eccentric shaft 71 is formed. Shaft 71 is eccentric with respect to the shaft center of rotary shaft 70.

Inside rotary shaft 70, oil path 72 is formed for the lubricant to flow. Suction port 73 for the lubricant is formed at the lower end of rotary shaft 70, and paddle 74 is formed above suction port 73. Oil path 72 communicates with suction port 73 and paddle 74, and is formed along an axial direction of rotary shaft 70. Oil path 72 includes oil supply port 75 for supplying oil to bearing section 61, oil supply port 76 for supplying oil to sub-bearing section 16, and oil supply port 77 for supplying oil to boss receptor 62.

Motor 80 is formed of stator 81 fixed to hermetic container 10 and rotor 82 disposed inside stator 81.

Rotor 82 is rigidly mounted to rotary shaft 70. Balancing weights 17*a*, 17*b* are mounted to rotary shaft 70 at above and below rotor 82. There is a 180 degrees differential between these two weights, namely they are placed radially opposite to each other. Use of centrifugal force produced by weights 17*a*, 17*b* and centrifugal force produced by orbiting motion of orbiting scroll 40 can keep balance. Balancing weights 17*a*, 17*b* can be rigidly mounted to rotor 82.

Self-rotation preventing member (Oldham's ring) 90 prevents orbiting scroll 40 from self-rotation. Orbiting scroll 40 is supported by stationary scroll 30 via self-rotation preventing member 90. This structure allows orbiting scroll 40 to perform an orbiting motion with respect to stationary scroll 30, and does not allow the self-rotation.

Pillar-shaped member 100 prevents stationary scroll 30 from rotating or from moving along the radial direction, but allows stationary scroll 30 to move along the axial direction. Stationary scroll 30 is supported by main bearing 60 with the aid of pillar-shaped member 100, and is movable along the axial direction between partition plate 20 and main bearing 60.

Stationary scroll 30, orbiting scroll 40, motor 80, self-rotation preventing member 90, and main bearing 60 are disposed in low pressure space 12, and yet, stationary scroll 30 and orbiting scroll 40 are disposed between partition plate 20 and main bearing 60.

Drive of motor 80 prompts rotor 82 and rotary shaft 70 to rotate. Eccentric shaft 71 causes orbiting scroll 40 to perform an orbiting motion, thereby compressing the coolant in compressing chamber 50.

The coolant is introduced from coolant suction pipe 13 to low pressure space 12. The coolant in low pressure space 12 and around outer periphery of orbiting scroll 40 is introduced into compressing chamber 50. The coolant is compressed in chamber 50, and then discharged from coolant discharge pipe 14 via high pressure space 11.

The spin of rotary shaft 70 allows the lubricant stored in oil pool 15 to enter oil path 72 from suction port 73. The lubricant is then drawn up upward along paddle 74 in oil path 72, and is supplied to bearing section 61, sub-bearing 16, and boss receptor 62 via oil-supply ports 75, 76, and 77 respectively. The lubricant drawn up to boss receptor 62 is introduced onto a sliding surface between main bearing 60 and orbiting scroll 40, and at the same time, the lubricant is discharged through return-pipe 63 and returns to oil pool 15.

Figure 2A:
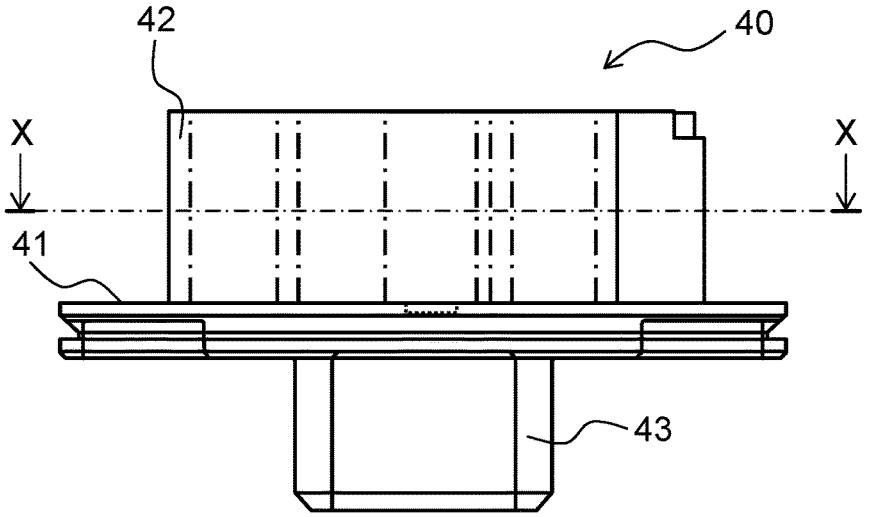
FIG. 2A is a lateral view showing an orbiting scroll of the hermetic scroll compressor in accordance with the first embodiment.
Figure 2B:
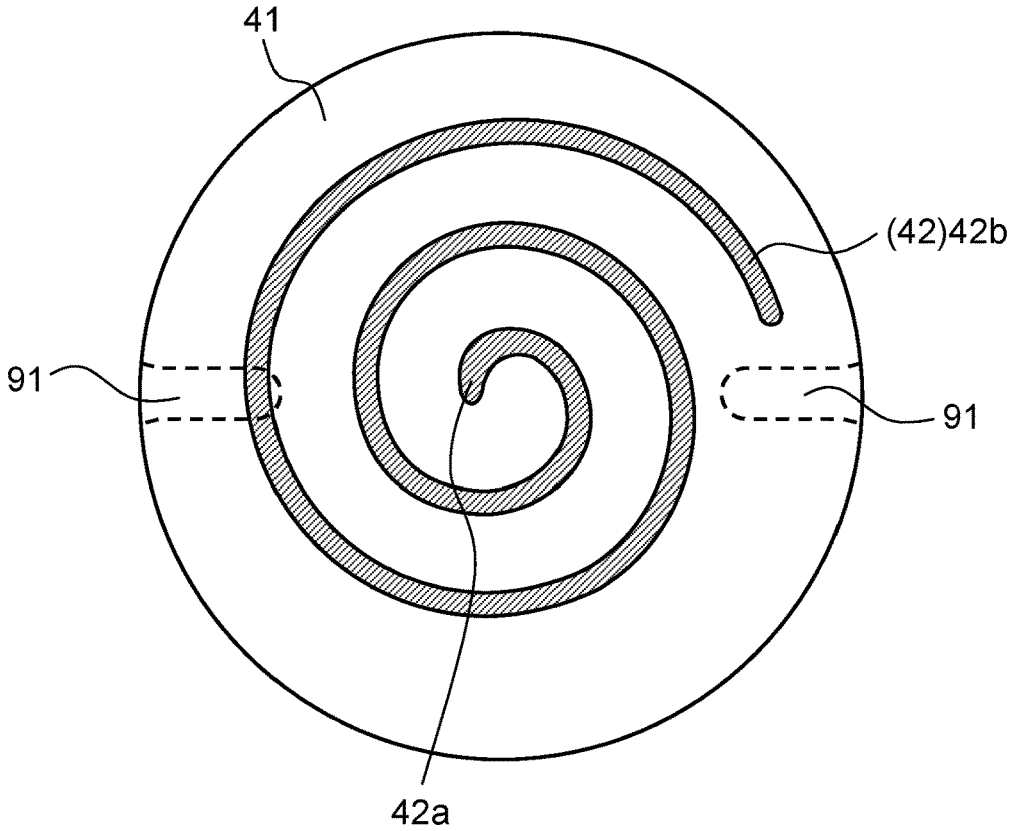
FIG. 2B is a sectional view cut along line X-X in FIG. 2A.

FIG. 2A is a lateral view of the orbiting scroll of the hermetic scroll compressor in accordance with the first embodiment. FIG. 2B is a sectional view cut along line X-X in FIG. 2A.

Orbiting scroll 40 includes disc-shaped orbiting scroll mirror plate 41, spiral-shaped orbiting spiral lap 42 standing on a top face of mirror plate 41, cylindrical-shaped boss 43 formed at approx. center of an underside of mirror plate 41.

Thickness of orbiting spiral lap 42 defined between an inner wall and an outer wall becomes gradually thinner from head 42*a* to tail end 42*b*. Orbiting spiral lap 42 thus tapers from head 42*a* to tail end 42*b*, thereby increasing a capacity of trapping a sucked gas, and this structure also allows reducing a weight of orbiting spiral lap 42, whereby centrifugal force due to whirling can be reduced.

A pair of first key slots 91 is formed on orbiting scroll mirror-plate 41.

Figure 3:
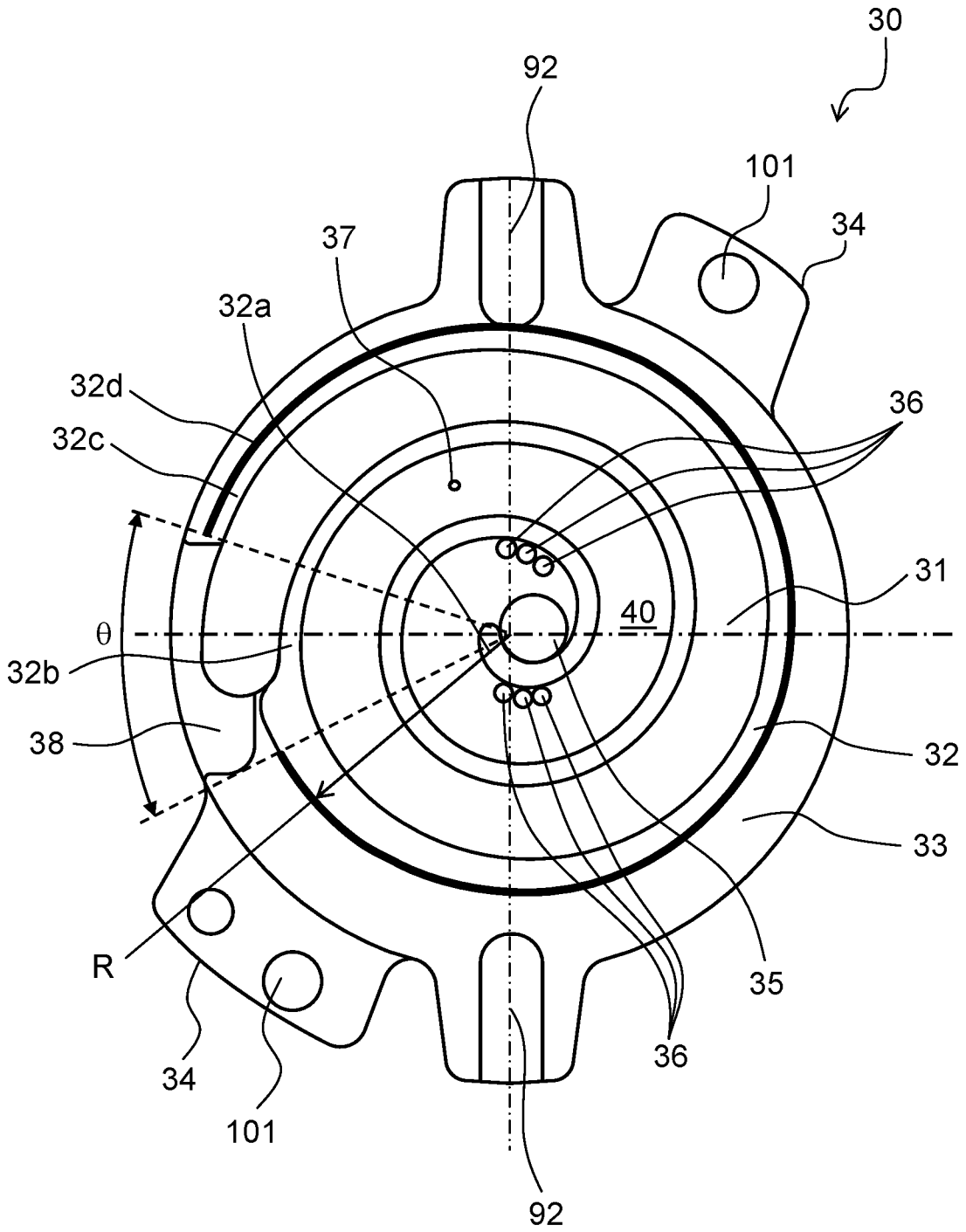
FIG. 3 is a bottom view of a stationary scroll of the hermetic scroll compressor in accordance with the first embodiment.
Figure 4:
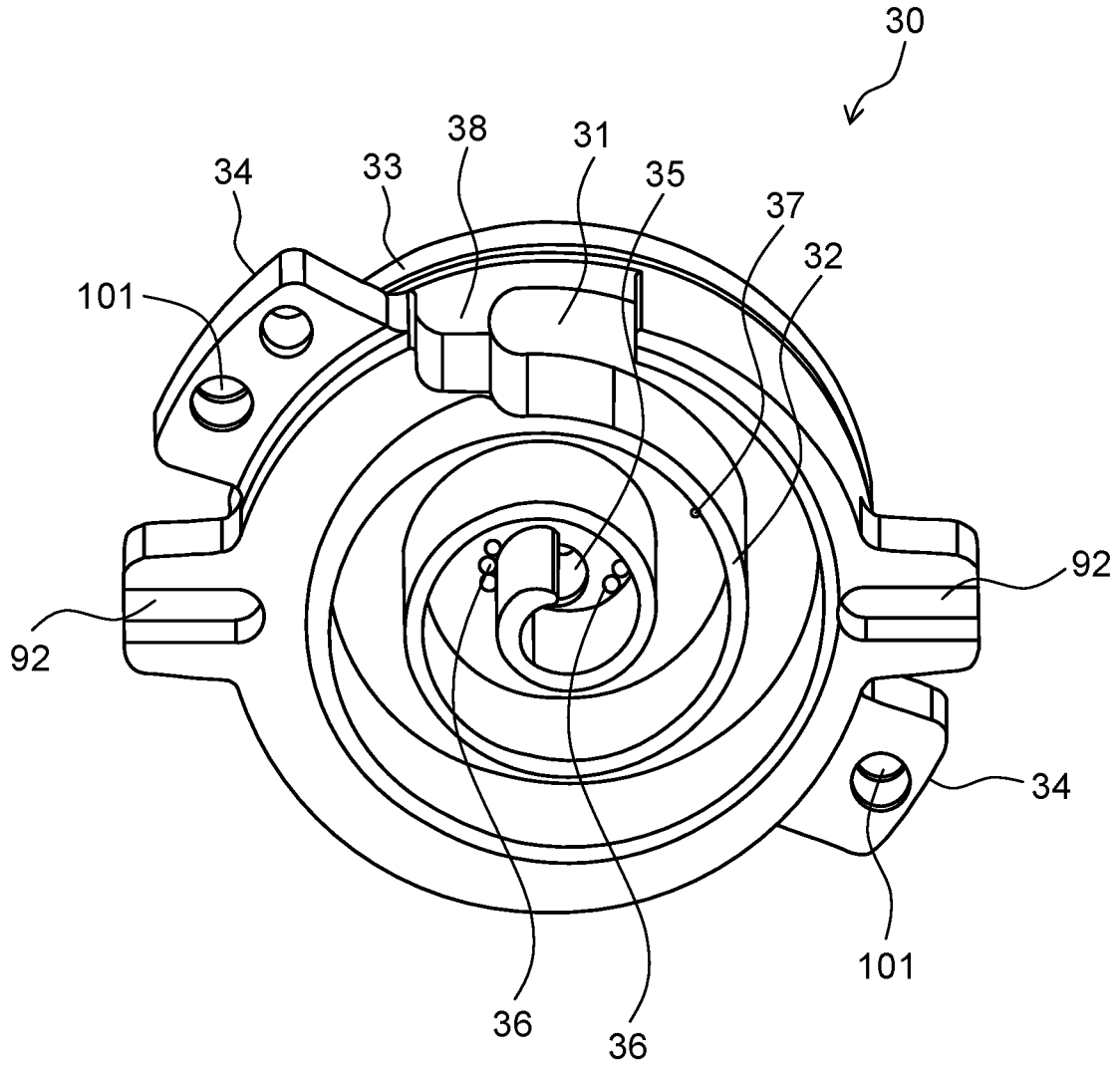
FIG. 4 is a perspective view of the stationary scroll viewed from the bottom side.
Figure 5:
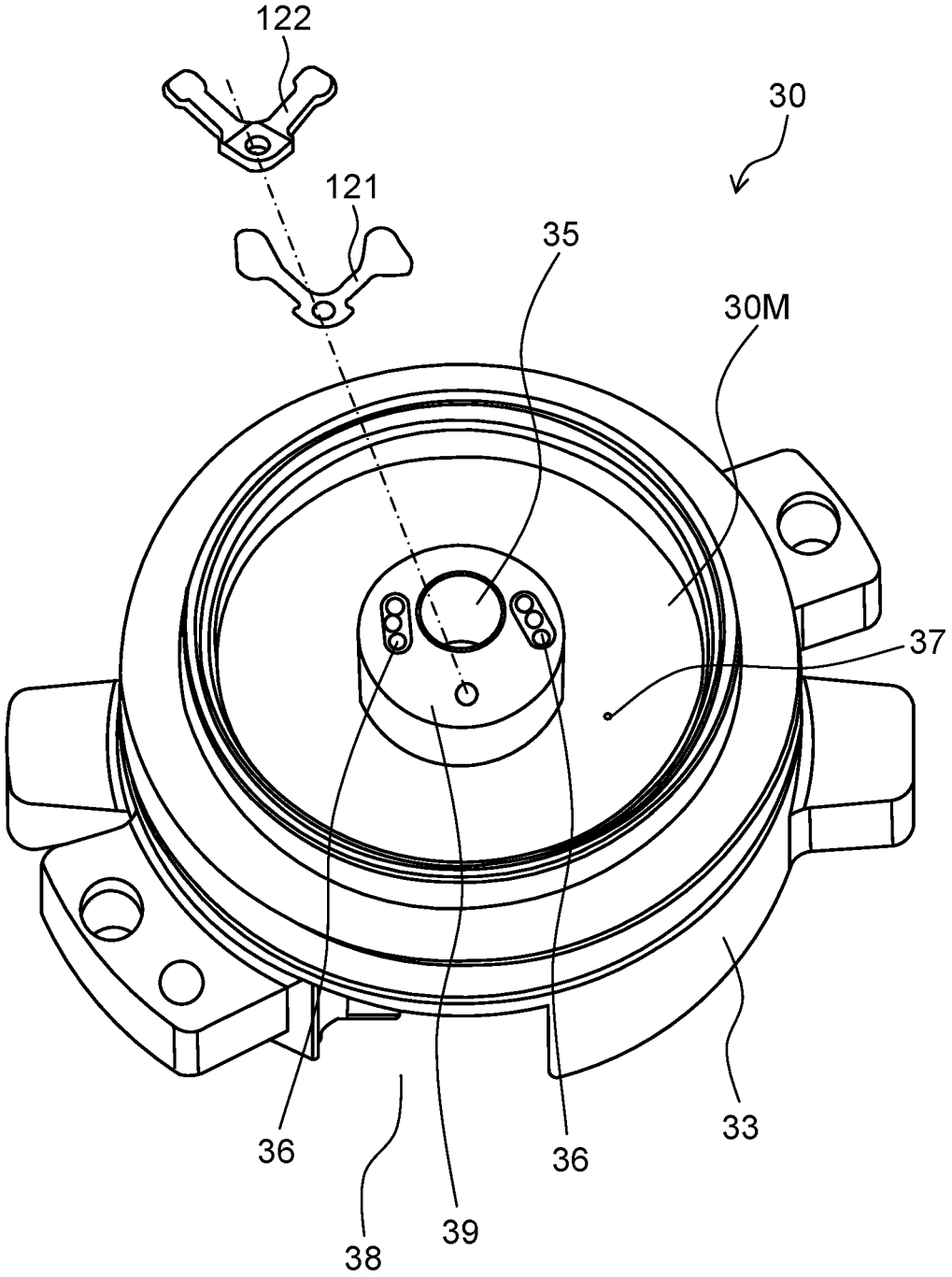
FIG. 5 is a perspective view of the stationary scroll viewed from the top side.

FIG. 3 is a bottom view of the stationary scroll of the hermetic scroll compressor in accordance with the first embodiment. FIG. 4 is a perspective view of the stationary scroll viewed from the bottom side. FIG. 5 is a perspective view of the stationary scroll viewed from the top side.

Stationary scroll 30 includes disc-shaped stationary scroll mirror-plate 31, spiral-shaped stationary spiral lap 32 standing on an underside of mirror plate 31, annular wall 33 surrounding stationary spiral lap 32, and flange 34 formed around annular wall 33.

Thickness of stationary spiral lap 32 defined by an inner wall and an outer wall becomes gradually thinner from head 32*a* to tail end 32*b*. From head 32*a* to tail end 32*b*, stationary spiral lap 32 is formed by the inner wall and the outer wall. Stationary spiral lap 32 is further extended from tail end 32*b* to outermost inner wall 32*c* only with the inner wall by approx. 340°. The tapering of stationary spiral lap 32 from head 32*a* to tail end 32*b* allows increasing a capacity of trapping a sucked gas, and this structure also allows reducing a weight of stationary spiral lap 32, whereby centrifugal force due to whirling can be reduced.

At an approx. center of stationary scroll mirror plate 31, first discharge port 35 is formed. Bypass ports 36 and medium pressure port 37 are formed on mirror plate 31. Bypass ports 36 are located near first discharge port 35 at a high pressure region formed just before completing the compression. Medium pressure port 37 is located near tail end 32*b* at a medium pressure region formed in the course of the compression.

Stationary scroll mirror plate 31 protrudes higher than flange 34.

Intake section 38 is formed on annular wall 33 and near flange 34 of stationary scroll 30 for sucking the coolant into compressing chamber 50. Second key slot 92 is formed in flange 34.

Scroll-side engagement section 101, into which an upper end of pillar-shaped member 100 is inserted, is formed in flange 34.

As FIG. 5 shows, boss section 39 is formed on a top face (the face confronting partition plate 20) of stationary scroll 30. In boss section 39, a recess working as discharge space 30H is formed (refer to FIG. 8). First discharge port 35 and bypass port 36 are formed in this discharge space 30H.

On the top face of stationary scroll 30, a ring-shaped recess is formed between annular wall 33 and boss section 39 for working as medium pressure space 30M that includes medium pressure port 37. A diameter of medium pressure port 37 is smaller than the thickness of orbiting spiral lap 42 defined by the inner wall and outer wall. This smaller diameter allows preventing compressing chamber 50 formed on the inner wall side of spiral lap 42 from communicating with another compressing chamber 50 formed on the outer wall side of spiral lap 42.

In discharge space 30H, bypass check valve 121 and bypass check-valve stopper 122 are disposed. Check valve 121 is capable of blocking bypass port 36 and employs a lead valve, which allows regulating the height of valve 121, and yet, use of a V-shaped lead valve allows blocking bypass port 36 that communicates with compressing chamber 50 formed on the outer wall side of orbiting spiral lap 42. The use of the V-shaped lead valve also allows blocking bypass port 36 that communicates with another compressing chamber 50 formed on the inner wall side of spiral lap 42.

The present disclosure proves that the tail ends of stationary spiral lap 32 and orbiting spiral lap 42 can be thinner, whereby the weights of stationary scroll 30 and orbiting scroll 40 can be reduced. The weight reduction in orbiting scroll 40, in particular, weakens the centrifugal force during the orbiting motion, thereby reducing load to bearing section 61. On top of that, balancing weights 17*a*, 17*b* provided to rotary shaft 70 can be downsized, so that a degree of freedom in design can be increased. Comparing with a conventional spiral lap, a greater involute angle can be available, so that a higher compression ratio and a greater capacity can be achieved. As a result, a scroll compressor of higher efficiency and smaller dimensions is obtainable.

Figure 6:
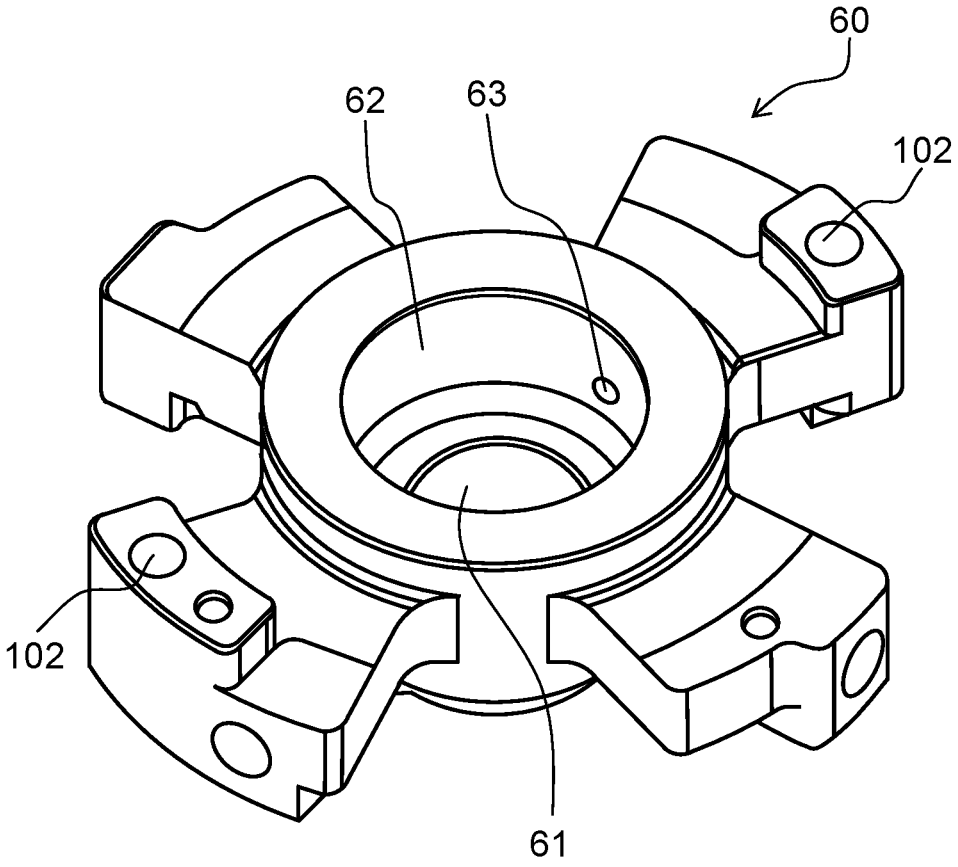
FIG. 6 is a perspective view of a main bearing of the hermetic scroll compressor in accordance with the first embodiment.

FIG. 6 is a perspective view of the main bearing of the hermetic scroll compressor in accordance with the first embodiment.

Bearing section 61 and boss receptor 62 are formed at approx. center of main bearing 60.

Bearing-side engagement section 102, into which a lower end of pillar-shaped member 100 is inserted, is formed at an outer periphery of bearing 60.

The bottom face of bearing-side engagement section 102 communicates with return pipe 63 of which first end opens at the sliding surface with orbiting scroll 40. The lubricant can be thus supplied to bearing-side engagement section 102 via return pipe 63.

Figure 7:
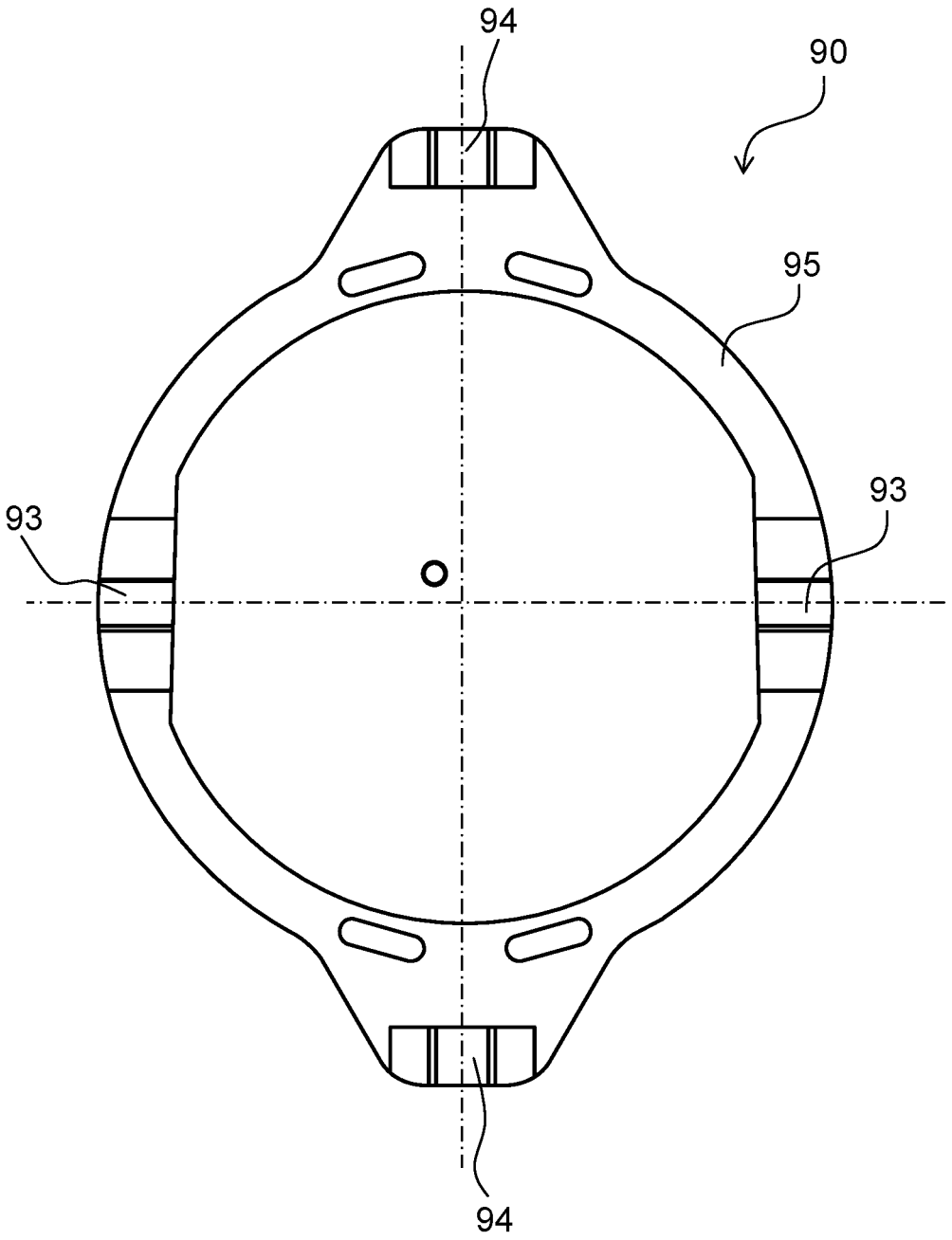
FIG. 7 is a top view of a self-rotation preventing member of the hermetic scroll compressor in accordance with the first embodiment.

FIG. 7 is a top view of the self-rotation preventing member of the hermetic scroll compressor in accordance with the first embodiment.

Self-rotation preventing member (Oldham's ring) 90 includes first key 93 and second key 94. First key 93 fits into first key slot 91 of orbiting scroll 40, and second key 94 fits into second key slot 92 of stationary scroll 30. This structure allows orbiting scroll 40 to orbit with respect to stationary scroll 30 and not to rotate by itself. As FIG. 1 shows, stationary scroll 30, orbiting scroll 40, and Oldham's ring 90 are disposed in this order from the top along the axial direction of rotary shaft 70. This structure allows first key 93 and second key 94 to be formed on the same plane of ring section 95 of Oldham's ring 90. During the production of Oldham's ring 90, this structure allows forming first key 93 and second key 94 from the same direction, so that the number steps of mounting and demounting Oldham's ring 90 to and from a processing machine can be reduced. As a result, the processing accuracy can be improved and the processing cost can be reduced.

Figure 8:
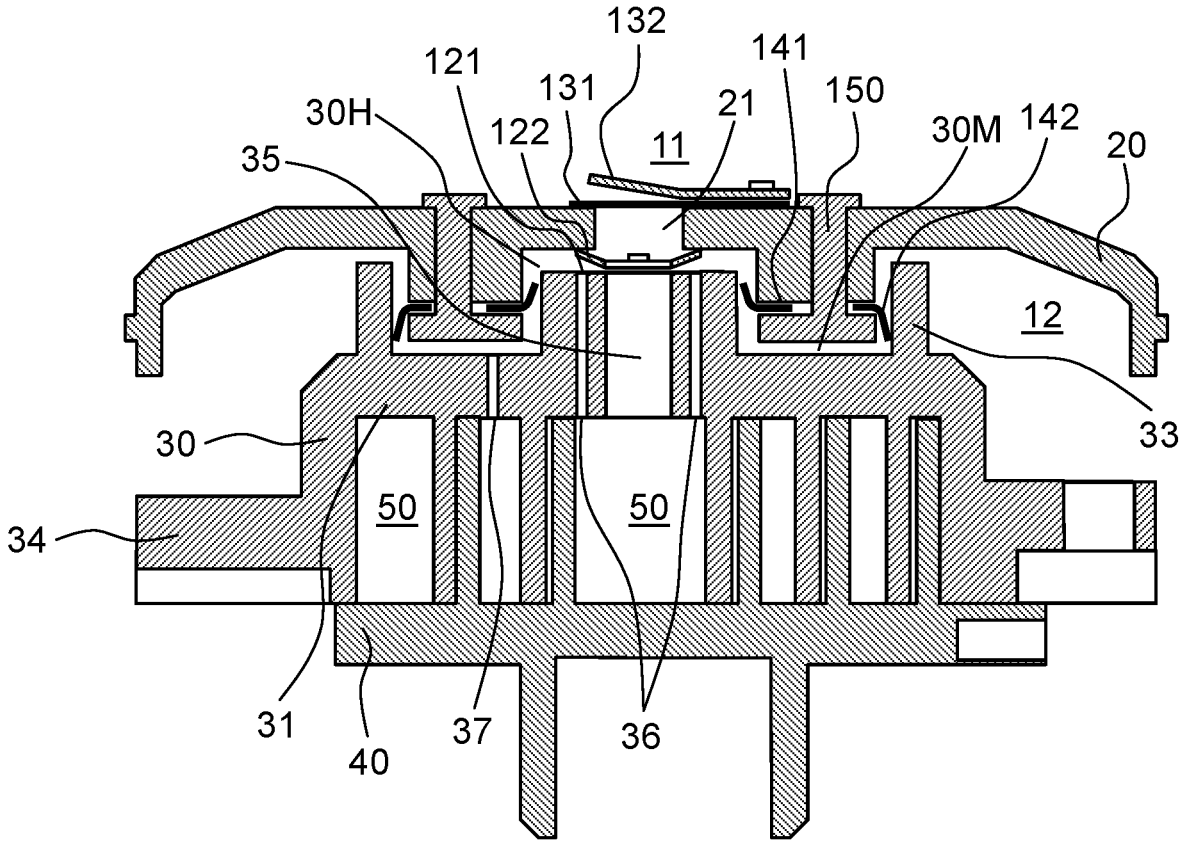
FIG. 8 is a sectional view of essential parts of a partition plate and the stationary scroll of the hermetic scroll compressor in accordance with the first embodiment.

FIG. 8 is a sectional view of essential parts of the partition plate and the stationary scroll of the hermetic scroll compressor in accordance with the first embodiment.

At the center of partition plate 20, second discharge port 21 is formed, and port 21 is provided with discharge check valve 131 and discharge check valve stopper 132.

Between partition plate 20 and stationary scroll 30, discharge space 30H that communicates with first discharge port 35 is formed. Second discharge port 21 allows discharge space 30H to communicate with high pressure space 11. Discharge check valve 131 can block second discharge port 21.

According to the first embodiment, a high pressure is applied to discharge space 30H formed between partition plate 20 and stationary scroll 30, whereby stationary scroll 30 is urged against orbiting scroll 40. This mechanism allows canceling gaps between stationary scroll 30 and orbiting scroll 40, so that an efficient operation can be expected.

According to the first embodiment, in addition to first discharge port 35, bypass port 36 also allows discharge space 30H to communicate with compressing chamber 50. Bypass port 36 is provided with bypass check valve 121. This structure allows preventing the backward flow of the coolant from discharge space 30H, and yet, introducing the coolant into discharge space 30H when the pressure reaches to a given level. This structure thus achieves a high efficiency in a wide operation range.

Discharge check valve 131 is formed thicker than bypass check valve 121.

First discharge port 35 has a smaller capacity than second discharge port 21 for reducing a loss in a discharge pressure from compressing chamber 50.

Second discharge port 21 is tapered at flow-in side for reducing a loss in the discharge pressure.

The hermetic scroll compressor in accordance with the first embodiment includes a ring-shaped first sealing member 141 disposed between partition plate 20 and stationary scroll 30 at outer periphery of discharge space 30H, and ring-shaped second sealing member 142 disposed between partition plate 20 and stationary scroll 30 at outer periphery of first sealing member 141.

First sealing member 141 and second sealing member 142 are preferably made of polytetrafluoroethylene, one of fluoro-resin, because this material is suited in terms of both sealing properties and assembling properties. Mixture of the fluoro-resin with fiber material will increase the reliability of the sealing.

First sealing member 141 and second sealing member 142 are pinched into partition plate 20 with blocking member 150, which is preferably made of aluminum material that allows partition plate 20 to be riveted with blocking member 150.

Between first sealing member 141 and second sealing member 142, medium pressure space 30M is formed. Through medium pressure port 37, space 30M communicates with compressing chamber 50 staying in a medium pressure region formed in the course of the compression, so that a pressure lower than the pressure of discharge space 30H and a pressure higher than the pressure of low pressure space 12 are applied to medium space 30M.

According to the first embodiment, in addition to discharge space 30H of high pressure, medium pressure space 30M is formed between partition plate 20 and stationary scroll 30. This structure allows adjusting with ease the urging force of stationary scroll 30 against orbiting scroll 40.

According to the first embodiment, first sealing member 141 and second sealing member 142 form discharge space 30H and medium pressure space 30M. This structure allows reducing a coolant leakage from discharge space 30H of high pressure to medium pressure space 30M, and from medium pressure space 30M to low pressure space 12.

According to the first embodiment, first sealing member 141 and second sealing member 142 are pinched into partition plate 20 with blocking member 150. This structure allows assembling partition plate 20, first sealing member 141, second sealing member 142, and blocking member 150 together before this assembled body is disposed in hermetic container 10, so that the number of components can be reduced and the scroll compressor can be assembled with ease.

Figure 9:
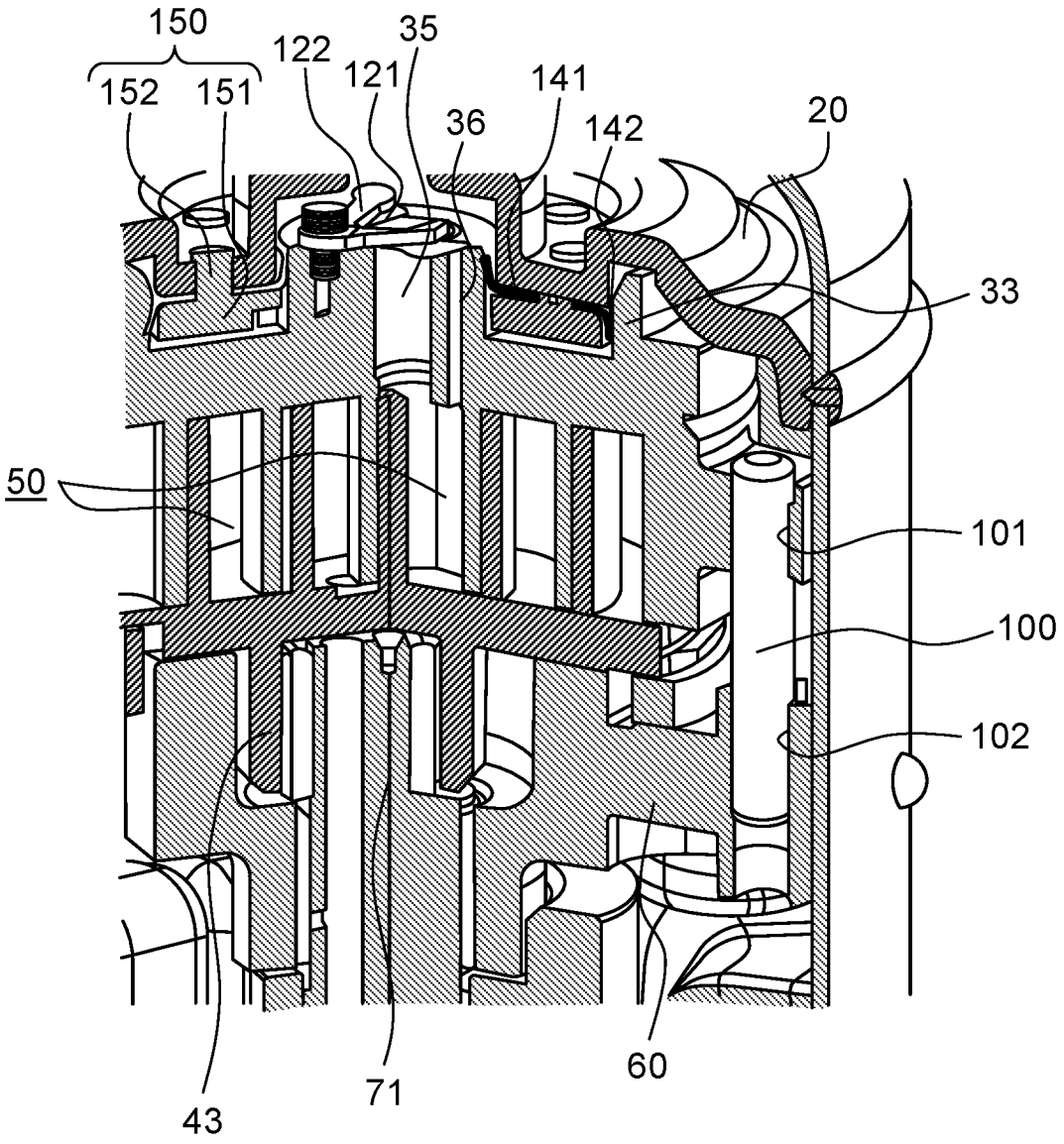
FIG. 9 is a perspective sectional view of essential parts of the hermetic scroll compressor in accordance with the first embodiment.

FIG. 9 is a perspective sectional view showing essential parts of the hermetic scroll compressor in accordance with the first embodiment.

Blocking member 150 described in FIG. 8 is formed of, as shown in FIG. 9, ring-shaped member 151 and multiple projections 152 formed on a first face of ring-shaped member 151.

First sealing member 141 is pinched at an outer periphery between a top face of ring-shaped member 151 at inner wall side and partition plate 20. Second sealing member 142 is pinched at an inner periphery between the top face of ring-shaped member 151 at outer wall side and partition plate 20.

Ring-shaped member 151 is mounted to partition plate 20 with first sealing member 141 and second sealing member 142 being pinched.

Blocking member 150 is mounted to partition plate 20 this way: projection 152 is inserted into hole 22 formed on partition plate 20, ring-shaped member 151 is urged against the underside of partition plate 20, and while this urging state is kept, an end of projection 152 is riveted so that blocking member 150 is rigidly mounted to partition plate 20.

In the state of blocking member 150 being mounted to partition plate 20, the inner periphery of first sealing member 141 protrudes toward the inner wall of ring-shaped member 151, and the outer periphery of second sealing member 142 protrudes toward the outer wall of ring-shaped member 151.

Partition plate 20, to which blocking member 150 is mounted, is fit into hermetic container 10, whereby the inner periphery of first sealing member 141 is urged against an outer wall of boss section 39, and the outer periphery of second sealing member 142 is urged against an inner face of annular wall 33 of stationary scroll 30.

A lower end of pillar-shaped member 100 is inserted into bearing-side engagement section 102 and fixed there (e.g. press-fit), and an upper end of pillar-shaped member 100 is engaged with scroll-side engagement section 101 in a slidable manner.

Figure 10:
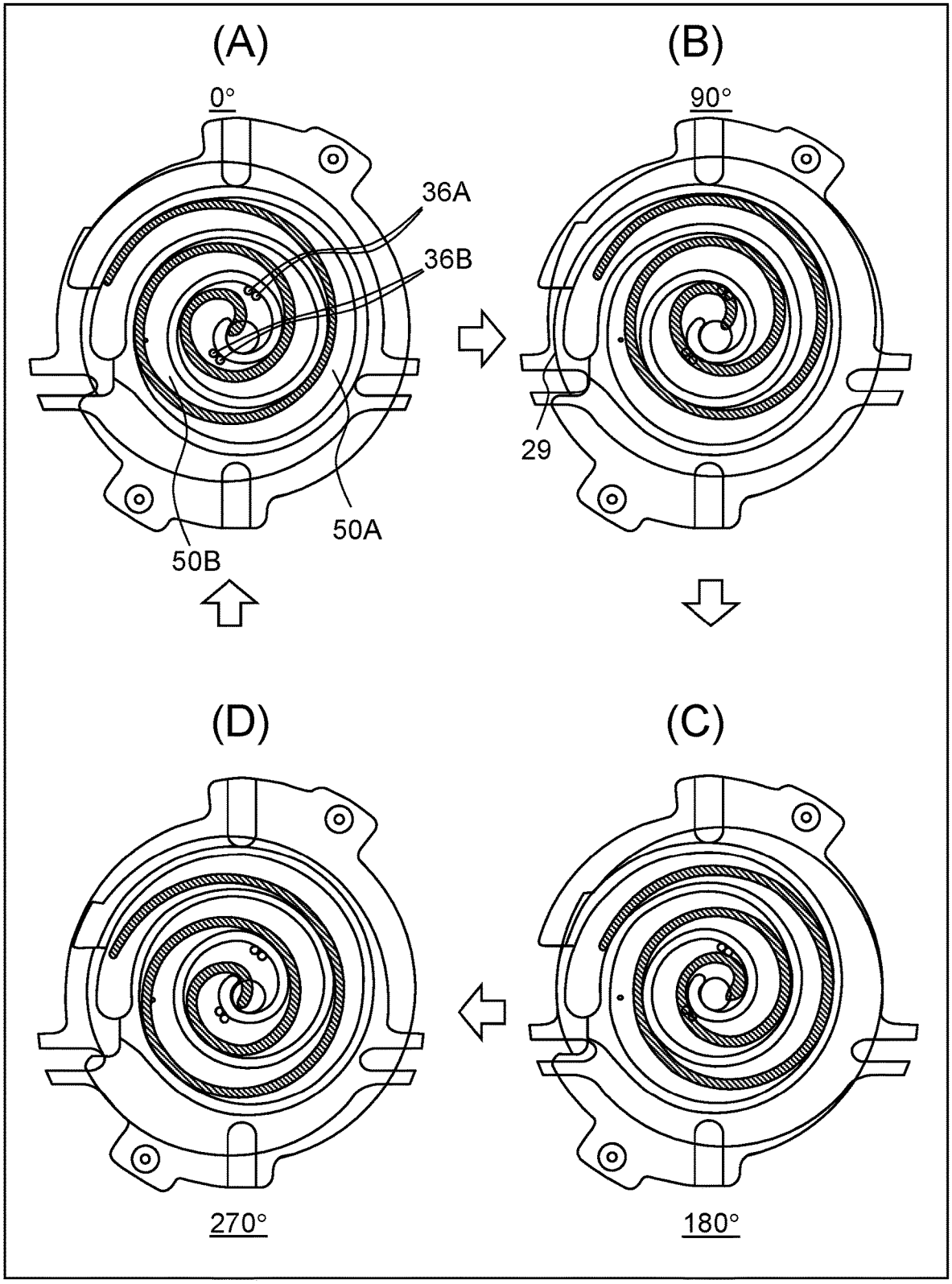
FIG. 10 shows relative positions between the orbiting scroll and the stationary scroll at some rotary angles.

FIG. 10 shows relative positions between the orbiting scroll and the stationary scroll at some rotation angles of the hermetic scroll compressor in accordance with the first embodiment.

FIG. 10(A) shows a state where compressing chamber 50A just has completed sucking the coolant and been closed. Compressing chamber 50A is formed of the outer wall of orbiting spiral lap 42 of orbiting scroll 40 and the inner wall of stationary spiral lap 32 of stationary scroll 30.

FIG. 10(B) shows a state where 90° forward rotation has been made from the state shown in FIG. 10(A). FIG. 10(C) shows a state where 90° forward rotation has been made from the state shown in FIG. 10(B). FIG. 10(D) shows a state where 90° forward rotation has been made from the state shown in FIG. 10(C). Forward rotation of 90° from the state shown in FIG. 10(D) will restore the state to the state shown in FIG. 10(A).

FIG. 10(C) shows a state where compressing chamber 50B just has completed suction and been closed. Compressing chamber 50B is formed by the inner wall of orbiting spiral lap 42 of orbiting scroll 40 and the outer wall of stationary spiral lap 32 of stationary scroll 30.

Compressing chamber 50A having just completed the suction and been closed in FIG. 10(A) moves toward the center of stationary scroll 30 with its capacity being decreased as shown in FIG. 10(B), FIG. 10(C), and FIG. 10(D). During the advancement from FIG. 10(C), where the rotation advances by 540°, to FIG. 10(D), compressing chamber 50A communicates with first discharge port 35. Before chamber 50A, which has completed the suction and been closed in FIG. 10(A), communicates with first discharge port 35, bypass port 36A allows chamber 50A to communicate with discharge space 30H. This structure allows performing the following mechanism: when a pressure in chamber 50A increases to a level enough to push up bypass check valve 121, the coolant in chamber 50A is introduced into discharge space 30H via bypass port 36A before chamber 50A communicates with first discharge port 35.

Compressing chamber 50B, shown in FIG. 10(C) and having completed the suction and been closed, moves toward the center of stationary scroll 30 with its capacity being decreased as shown in FIG. 10(D), FIG. 10(A), and FIG. 10(B). During the advancement from FIG. 10(C), in which the rotation advances by 360°, to FIG. 10(D), compressing chamber 50B communicates with first discharge port 35. Before chamber 50B, which has completed the suction and been closed, communicates with first discharge port 35, bypass port 36B allows chamber 50B to communicate with discharge space 30H. This structure allows performing the following mechanism: when a pressure in chamber 50B increases to a level enough to push up bypass check valve 121, the coolant in chamber 50B is introduced into discharge space 30H via bypass port 36B before chamber 50B communicates with first discharge port 35.

As discussed above, compressing chambers 50A, 50B communicate with discharge space 30H via bypass ports 36A, 36B in addition to first discharge port 35. The presence of bypass check valves 121 in bypass ports 36A, 36B prevents the coolant from flowing backward from discharge space 30H, and yet, allows introducing the coolant into discharge space 30H when the pressure reaches to the given level. This structure thus achieves a high efficiency in a wide operation range.

As FIG. 10(A)-FIG. 10(D) illustrate, medium pressure port 37 is located at such a position that communicates with compressing chamber 50A just after the sucking and the closing is completed as shown in FIG. 10(A) or at such a position that also communicates with compressing chamber 50B just after the sucking and the closing is completed as shown in FIG. 10(C).

In the first embodiment, the inner wall of stationary spiral lap 32 is extended near tail end 32*b* of orbiting spiral lap 42. This structure allows differentiating the trapping capacity of compressing chamber 50A from that of compressing chamber 50B, where chamber 50A is formed by the inner wall of stationary spiral lap 32 and the outer wall of orbiting spiral lap 42, and chamber 50B is formed by the outer wall of stationary spiral lap 32 and the inner wall of orbiting spiral lap 42.

According to the first embodiment, obtaining the maximum trapping capacity of sucked gas will allow increasing a compression ratio, so that the heights of stationary spiral lap 32 and orbiting spiral lap 42 can be lowered. As a result, stationary scroll 30 can move along the axial direction between partition plate 20 and main bearing 60. Lower heights of stationary spiral lap 32 and orbiting spiral lap 42 will allow stationary scroll 30 to work in a stable manner in the scroll compressor in which stationary scroll 30 is urged against orbiting scroll 40 by the pressure of discharge space 30H for obtaining strict hermetic properties between stationary scroll 30 and orbiting scroll 40.

In the first embodiment, the suction closing position in compressing chamber 50A and that in compressing chamber 50B are located near intake section 38, whereby a length of a path for sucking the coolant can be minimized so that a loss in heating can be reduced.

Figure 11:
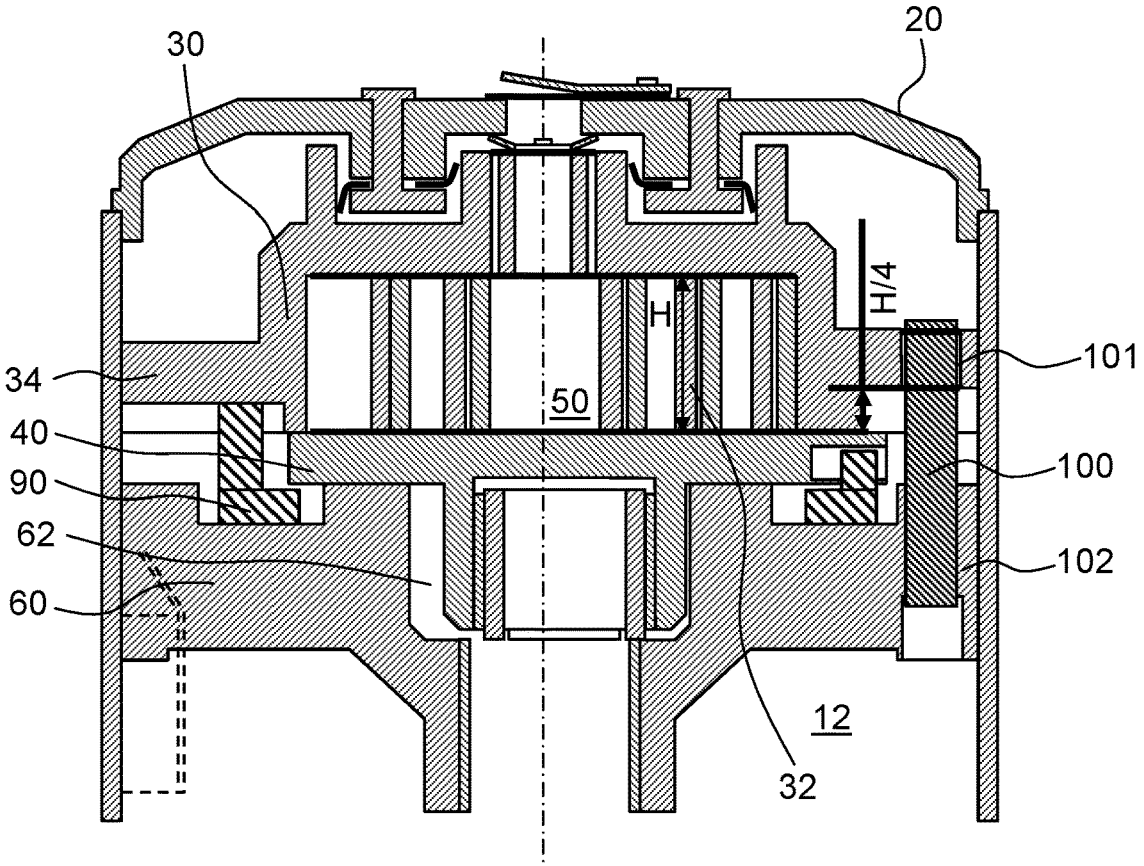
FIG. 11 is a longitudinal sectional view showing a positional relation between an engagement position and a stationary scroll spiral lap of the hermetic scroll compressor in accordance with the first embodiment.

FIG. 11 is a longitudinal sectional view illustrating a positional relation between an engagement position of the hermetic scroll compressor and the stationary spiral lap in accordance with the first embodiment.

A lower end of an engagement section between scroll-side engagement section 101 and pillar-shaped member 100 is located in a different level from an end of stationary spiral lap 32. A gas compression pressure above pillar-shaped member 100 acts on a center position of the height of the spiral lap 32. The gas compression pressure is supported by the engagement section between stationary scroll 30 and pillar-shaped member 100.

In the first embodiment, this structure shortens a distance between a point of action and a supporting point of the gas compression pressure above pillar-shaped member 100, so that an overturn moment can be reduced. As a result, yield strength to the overturn is increased.

The lower end of the engagement section between pillar-shaped member 100 and scroll-side engagement section 101 is located at a height equal to or greater than ¼ height of stationary spiral lap 32 from the end face of stationary spiral lap 32.

Figure 12:
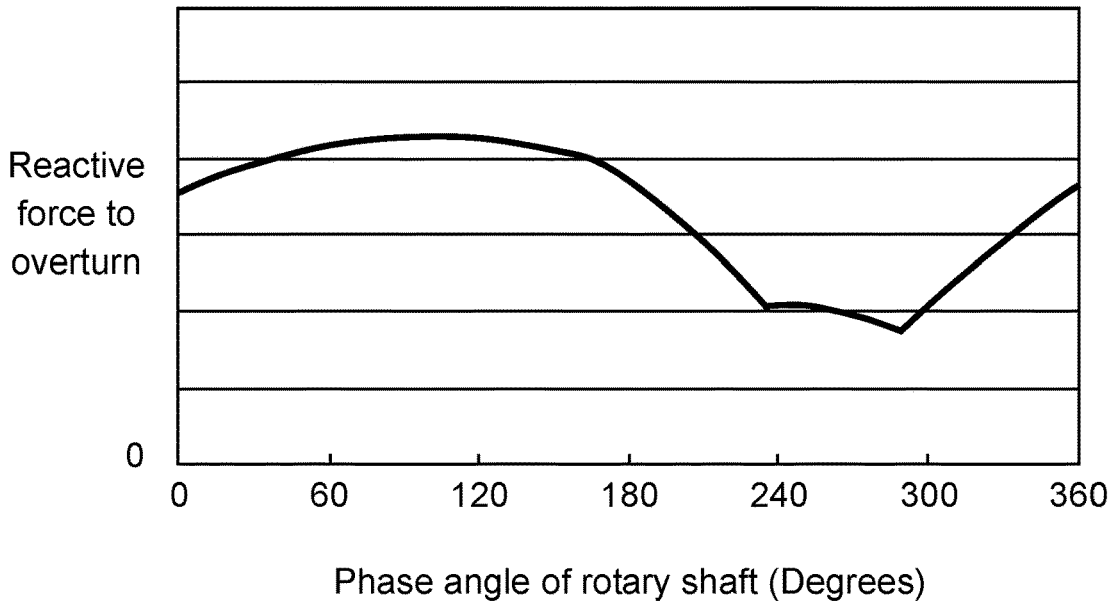
FIG. 12 shows a relation between a phase angle of a rotary shaft and reactive force to an overturn in accordance with the first embodiment.

FIG. 12 shows a relation between reactive force to the overturn and a phase angle of rotary shaft 70 assuming that the phase angle stands at 0° when a first compressing chamber (compressing chamber 50A shown in FIG. 10(A)) is closed. As FIG. 12 shows, the aforementioned location of the lower end of the engagement section between pillar-shaped member 100 and scroll-side engagement section 101 makes the reactive force to the overturn be positive values over all the phase angles. In other words, stationary scroll 30 will not overturn at any phase angle.

In the scroll compressor in accordance with the first embodiment, the inner wall of stationary spiral lap 32 of stationary scroll 30 is extended near the tail end of orbiting spiral lap 42 of orbiting scroll 40. This structure allows differentiating a trapping capacity of a first compressing chamber from that of a second compressing chamber, where the first chamber is formed by the inner wall of stationary spiral lap 32 and the outer wall of orbiting spiral lap 42, and the second chamber is formed by the outer wall of stationary spiral lap 32 and the inner wall of orbiting spiral lap 42. This structure thus allows obtaining the maximum trapping capacity for sucked gas, and increasing the compression ratio, so that the heights of the stationary spiral lap and the orbiting spiral lap can be lowered. This structure shortens a distance between a point of action and a supporting point of the gas compression pressure above pillar-shaped member 100, so that an overturn moment can be reduced. As a result, yield strength to the overturn is further increased.

The scroll compressor in accordance with the first embodiment includes bypass port 36 that is formed in stationary scroll 30 and allows compressing chamber 50 to communicate with discharge space 30H, and bypass check valve 121 that can block bypass port 36. This structure allows introducing the coolant into the discharge space 30H when the pressure reaches to a given level, so that the compressor can operate at a lower gas compressive force. As a result, the yield strength to the overturn can be further increased.

As discussed above, according to the first embodiment, the yield strength to the overturn of the scroll compressor can be increased, so that the reliability thereof can be increased.

Second Exemplary Embodiment

The second embodiment is demonstrated hereinafter. Structural elements not specifically described here remain the same as those of the first embodiment, so that the descriptions thereof are omitted here.

Figure 13:
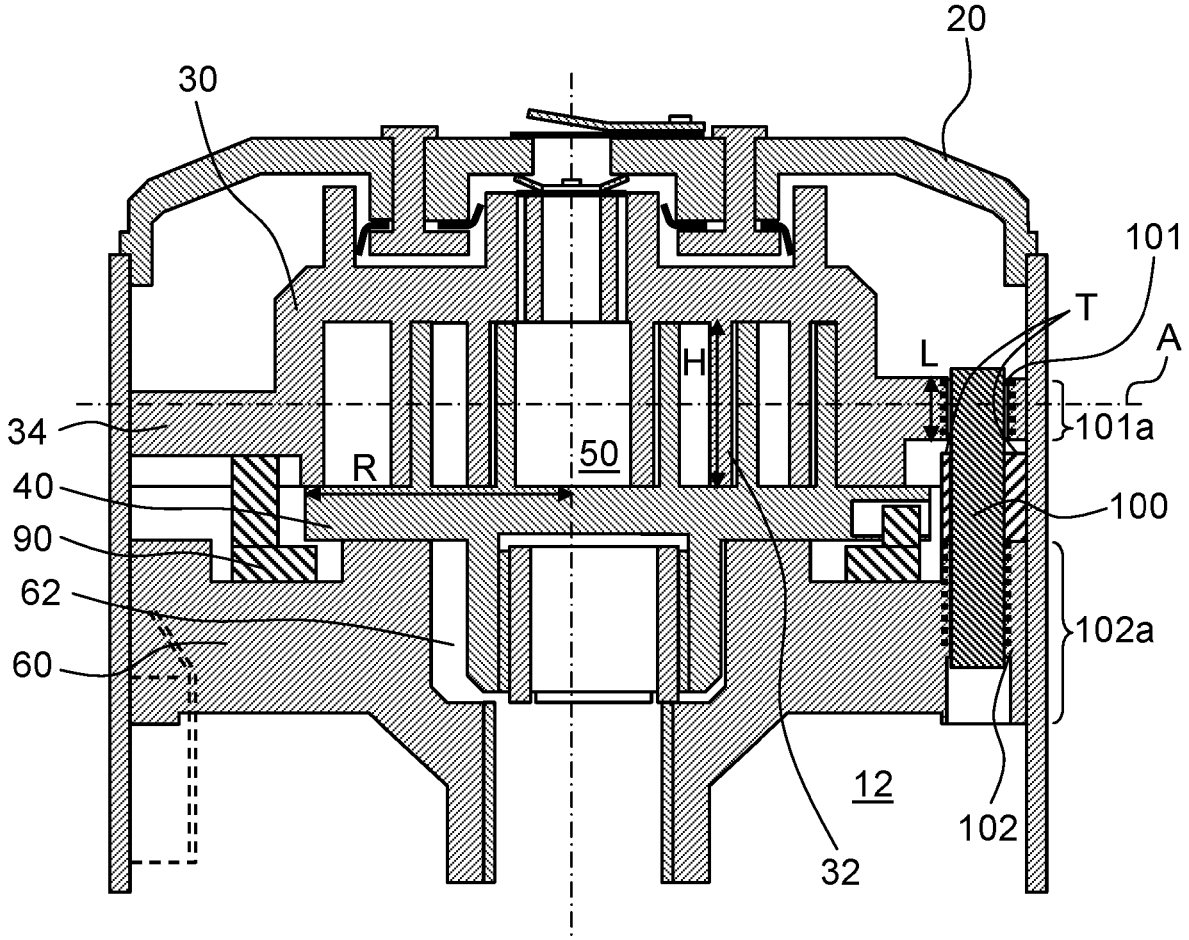
FIG. 13 is a longitudinal sectional view illustrating a positional relation between a horizontal plane running through the center of the spiral lap height and an engagement region of a hermetic scroll compressor in accordance with a second embodiment.

FIG. 13 is a longitudinal sectional view showing a positional relation between horizontal plane A running through a center of height H of stationary spiral lap 32 and an engagement section of the hermetic scroll compressor in accordance with the second embodiment.

Bearing-side engagement section 102 is formed on an outer wall of main bearing 60, and scroll-side engagement section 101 is formed on stationary scroll 30.

A lower end of pillar-shaped member 100 is inserted into and fixed to (press-fit) bearing-side engagement section 102 and an upper end thereof is engaged with scroll-side engagement section 101 in a slidable manner.

Assume that stationary spiral lap 32 of stationary scroll 30 has a height of H, then engagement region 101*a* between pillar-shaped member 100 and scroll-side engagement section 101 intersects horizontal plane A running through the center of height H.

In this second embodiment, an upper end-face T of bearing-side engagement section 102 is located above an end-face of stationary spiral lap 32.

The structure discussed above allows shortening a distance in an axial direction between engagement region 101*a* and upper end-face T of bearing-side engagement section 102 of main bearing 60, where engagement region 101*a* supports gas resultant forces in radial direction and in tangential direction of stationary scroll 30, and engagement section 102 engages and fixes the lower end of pillar-shaped member 100. This shorter distance will minimize a rotation moment applied to pillar-shaped member 100 in a horizontal direction, so that the reliability of the compressor can be increased. This structure also prevents stationary scroll 30 from rocking, so that more stable operation can be expected.

In this second embodiment, use of two pillar-shaped members will prevent efficiently the stationary scroll from rocking. In this case, the two pillar-shaped members are placed radially opposite to each other (i.e. the two members are placed at approx. 180° interval with respect to approx. center of main bearing 60, bearing section 61, or boss receptor 62). This structure allows minimizing the number of components, and thus the cost of the compressor can be reduced.

The number of pillar-shaped members is not limited to two; but three or more than three members can achieve the advantages of the present disclosure. In this case, these members are desirably placed at approx. equal intervals (e.g. in the case of three members, the interval is approx. 120°, and in the case of four members the interval is approx. 90°).

As discussed above, the second embodiment proves that the stationary scroll can be efficiently prevented from rocking, so that the reliability of the scroll compressor can be increased.

As discussed previously, the scroll compressor in accordance with a first aspect of the present disclosure comprises the following structural elements: the partition plate for dividing the hermetic container into the high pressure space and the low pressure space, the stationary scroll that abuts on the partition plate and includes the stationary spiral lap, the orbiting spiral lap engaged with the stationary spiral lap, the orbiting scroll that forms the compressing chamber between these laps (i.e. stationary spiral lap and orbiting spiral lap), the self-rotation preventing member for preventing the orbiting scroll from rotating, and the main bearing for supporting the orbiting scroll. The stationary scroll, orbiting scroll, self-rotation preventing member, and main bearing are disposed in the low pressure space. The stationary scroll is movable along the axial direction between the partition plate and the main bearing. The scroll compressor further comprises the bearing-side engagement section formed on the main bearing, the scroll-side engagement section formed on the stationary scroll, and the pillar-shaped member, of which lower section is inserted into the bearing-side engagement section and of which upper section is inserted into the scroll-side engagement section. The lower end-face of the engagement section between the pillar-shaped member and the scroll-side engagement section is located above the lap end face of the stationary spiral lap in the axial direction.

According to the first aspect, the scroll compressor of high reliability is obtainable.

The scroll compressor according to a second aspect of the present disclosure has the following structure in addition to the structure of the first aspect: the end-face of the engagement section between the pillar-shaped member and the scroll-side engagement section is located below the lap bottom face of the stationary spiral lap in the axial direction.

The scroll compressor according to a third aspect of the present disclosure has the following structure in addition to the structures of the first and second aspects: the lower section of the pillar-shaped member is inserted into and fixed to the bearing-side engagement section and the upper section thereof is inserted into the scroll-side engagement section in a slidable manner. The upper end-face of the bearing-side engagement section is located above the lap end-face of the stationary spiral lap.

The scroll compressor according to a fourth aspect of the present disclosure has the following structure in addition to the structures of the first through the third aspects: the lower end-face of the engagement section between the pillar-shaped member and the scroll-side engagement section is located at a height equal to or greater than ¼ height of the stationary lap from the end face of the stationary spiral lap in the axial direction.

The scroll compressor according to a fifth aspect of the present disclosure has the following structure in addition to the structures of the first through the fourth aspects: the inner wall of the stationary spiral lap is extended to a position near the tail end of the orbiting spiral lap. This structure allows differentiating the trapping capacity of the first compressing chamber from that of the second compressing chamber, where the first chamber is formed by the inner wall of the stationary spiral lap and the outer wall of the orbiting spiral lap and the second chamber is formed by the outer wall of the stationary spiral lap and the inner wall of the orbiting spiral lap.

The scroll compressor according to a sixth aspect of the present disclosure has the following structure in addition to the structures of the first through the fifth aspects: the scroll compressor includes the bypass port formed in the stationary scroll and allowing the compressing chamber to communicate with the discharge space, and the bypass check valve capable of blocking the bypass port.

INDUSTRIAL APPLICABILITY

The present disclosure is useful for compressors to be used in devices that work with a freezing cycle and are used in electric apparatuses (e.g. hot-water supplier, hot-water heater, air conditioner).

DESCRIPTION OF REFERENCE MARKS

10 hermetic container
11 high pressure space
12 low pressure space
20 partition plate
21 second discharge port
30 stationary scroll
30H discharge space
30M medium pressure space
31 stationary scroll mirror plate
32 stationary spiral lap
33 annular wall
34 flange
35 first discharge port
36, 36A, 36B bypass port
37 medium pressure port
38 intake section
39 boss section
40 orbiting scroll
41 orbiting scroll mirror plate
42 orbiting spiral lap
43 boss
50, 50A, 50B compressing chamber
60 main bearing
61 bearing section
62 boss receptor
63 return pipe
70 rotary shaft
71 eccentric shaft
72 oil path
73 suction port
74 paddle
75, 76, 77 oil supply port
80 motor
90 self-rotation preventing member (Oldham's ring)
100 pillar-shaped member

101 scroll-side engagement section
102 bearing-side engagement section
121 bypass check valve
131 discharge check valve
141 first sealing member
142 second sealing member
150 blocking member

The invention claimed is:

1. A scroll compressor comprising:

a partition plate for partitioning a hermetic container into a high pressure space and a low pressure space;

a stationary scroll abutting on the partition plate and including a stationary spiral lap;

an orbiting scroll including an orbiting spiral lap engaged with the stationary spiral lap of the stationary scroll, and forming a compressing chamber between the stationary spiral lap and the orbiting spiral lap;

a self-rotation preventing member for preventing the orbiting scroll from rotating; and a main bearing for supporting the orbiting scroll, wherein the stationary scroll, the orbiting scroll, the self-rotation preventing member, and the main bearing are disposed in the low pressure space, wherein the stationary scroll is movable between the partition plate and the main bearing in an axial direction, wherein the scroll compressor further comprises:

a bearing-side engagement section formed on the main bearing;

a scroll-side engagement section formed on the stationary scroll;

a single pillar-shaped member, of which a lower section is inserted into the bearing-side engagement section, and of which an upper section is inserted into the scroll-side engagement section, the single pillar-shaped member being inserted into and fixed to the bearing-side engagement section, and also being inserted into the scroll-side engagement section in a slidable manner;

a sliding surface between the single pillar-shaped member and the scroll-side engagement section; and a boss section formed on a top face of the stationary scroll, the boss section forming a discharge space between the partition plate and the stationary scroll, wherein the discharge space communicates with the high pressure space via a second discharge port, wherein a lower end-face of an engagement section between the single pillar-shaped member and the scroll-side engagement section is located above a lap end-face of the stationary spiral lap in the axial direction, wherein a first discharge port is formed at a center portion of the boss section and a bypass port is provided near the first discharge port in the boss section, wherein the first discharge port and the bypass port allow the compressing chamber of the scroll compressor to communicate with the discharge space, and wherein a bypass check valve and a bypass check-valve stopper are disposed in the discharge space.

2. The scroll compressor according to claim 1, wherein an upper end-face of the engagement section between the single pillar-shaped member and the scroll-side engagement section is located below a lap bottom face of the stationary spiral lap in the axial direction.

3. The scroll compressor according to claim 2, wherein the lower end-face of the engagement section between the single pillar-shaped member and the scroll-side engagement section is located higher than the lap end-face of the stationary spiral lap in the axial direction by a height equal to or greater than ¼ height of the stationary spiral lap.

4. The scroll compressor according to claim 1, wherein an upper end-face of the bearing-side engagement section is located above the lap end-face of the stationary spiral lap in the axial direction.

5. The scroll compressor according to claim 1, wherein an inner wall of the stationary spiral lap is extended to a position near a tail end of the orbiting spiral lap for differentiating a trapping capacity of a first compressing chamber from a trapping capacity of a second compressing chamber, where the first compressing chamber is formed by the inner wall of the stationary spiral lap and an outer wall of the orbiting spiral lap, and the second compressing chamber is formed by an outer wall of the stationary spiral lap and an inner wall of the orbiting spiral lap.

* * * * *